United States Patent [19]

Williams

[11] Patent Number: 4,976,376

[45] Date of Patent: Dec. 11, 1990

[54] PRIZE DISPENSING MACHINE PROVIDING THE APPEARANCE OF DISCHARGING PRIZES AS A MATTER OF CHANCE

[75] Inventor: Geoffrey A. Williams, Rochdale, England

[73] Assignee: Topline Leisure Ltd., England

[21] Appl. No.: 309,155

[22] Filed: Feb. 13, 1989

[30] Foreign Application Priority Data

Feb. 16, 1988 [GB] United Kingdom ..... 8803573

[51] Int. Cl.[5] ..... G07F 11/00

[52] U.S. Cl. ..... 221/24; 221/196; 221/265; 221/277; 194/229; 446/300

[58] Field of Search ..... 221/3, 24, 194, 195, 221/196, 224, 237, 258, 265, 266, 277; 194/229, 350; 446/9, 298, 299, 300, 301, 302, 303, 304

[56] References Cited

U.S. PATENT DOCUMENTS

| | | | |
|---|---|---|---|
| 552,529 | 1/1896 | Hirschfeld | 221/24 X |
| 825,555 | 7/1906 | Pool | 221/24 |
| 868,632 | 10/1907 | Almstrom et al. | 221/24 X |
| 1,725,965 | 8/1929 | Ormiston | 221/24 |
| 1,804,580 | 5/1931 | Whitesides | 221/24 X |
| 2,772,811 | 12/1956 | Schoef | 221/196 X |
| 2,855,124 | 10/1958 | Gensmer | 221/24 |
| 2,880,906 | 4/1959 | Probasco | 221/265 X |

*Primary Examiner*—Joseph J. Rolla

*Attorney, Agent, or Firm*—Oliff & Berridge

[57] ABSTRACT

A dispensing machine (100) is divided into three compartments (110, 112, 114). An animal-like figure including the body and head of an elephant (118) is located in a central compartment (112) and the head (118) can be rotated on the body by a drive mechanism (134) in the upper compartment (114). A number of non-prize containing packages (130) are provided in the central compartment (112) and prize-containing packages are located in the upper compartment (114). In operation, upon insertion of coins into the coin mechanism (154) the drive mechanism (134) is operated and causes the head (118) to turn through 360° passing through the non-prize containing packages (130). Upon each cycle, one prize-containing package from the upper compartment (114) is released from the upper compartment and passes into the passage (112) in the head (118). The prize-containing package is discharged from the trunk of the head through opened bottomed bucket (128) into a prize-receiving receptacle (166).

10 Claims, 3 Drawing Sheets

Figure 1:
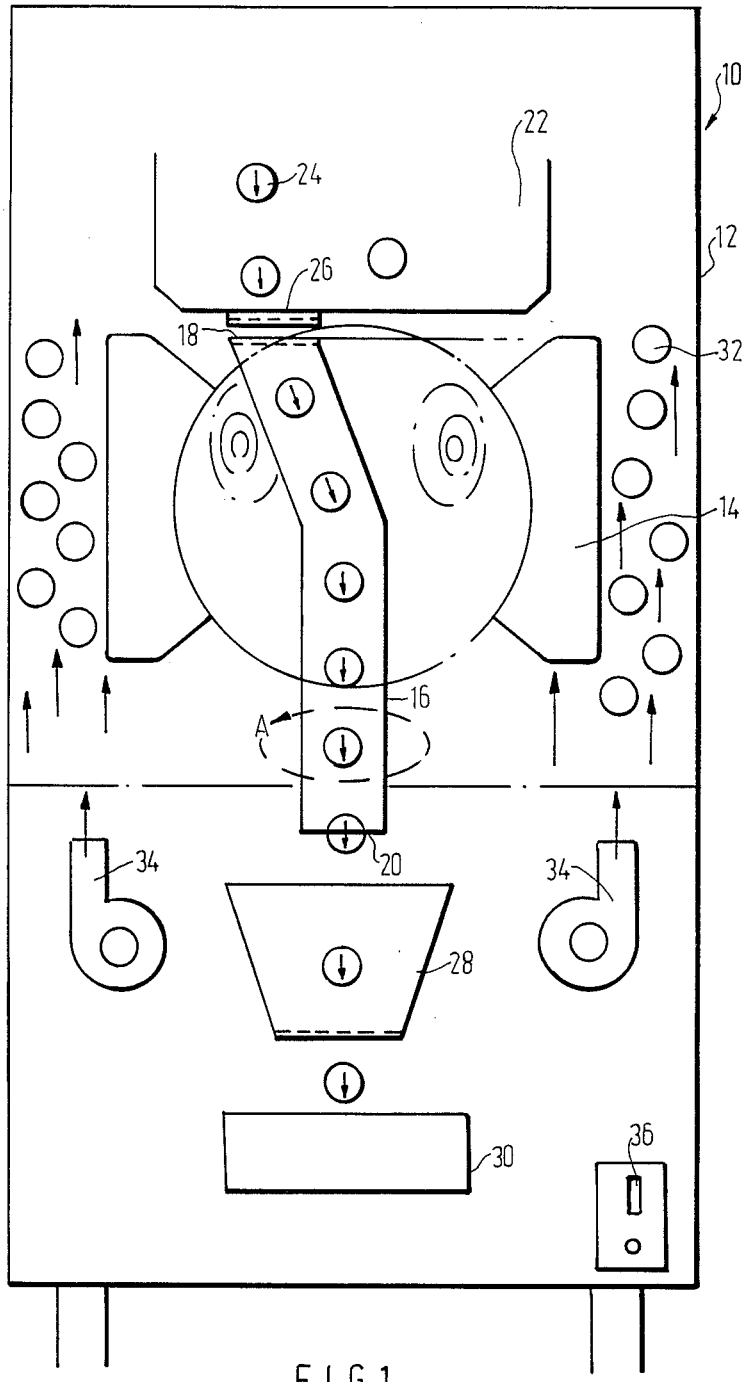

PRIZE DISPENSING MACHINE PROVIDING THE APPEARANCE OF DISCHARGING PRIZES AS A MATTER OF CHANCE

This invention relates to a machine for dispensing prizes upon insertion of appropriate coins or tokens, apparently as a matter of chance.

The present invention intends to provide a machine which apparently discharges prizes as a matter of chance, although one prize is dispensed each and every time the correct coinage or number of tokens is inserted.

Accordingly, the present invention provides a dispensing machine comprising a first receptacle having an outlet for a plurality of prize containing packages, a second receptacle having an animal like figure at least a part of which is movable in relation to the prize containing receptacle, a partition separating the first receptacle from the second receptacle and including a partition opening offset from the outlet of the first receptacle, and gating means disposed between the first and second receptacles for transporting a prize containing package from the outlet of the first prize containing receptacle to the partition opening for entry into the inlet of the passage in the second receptacle, the machine further comprises a plurality of non-prize containing packages through which the movable part of the animal-like figure is movable, and actuating means comprising a mechanism arranged to receive coins or tokens and drive means actuated by the actuating means upon receipt of a pre-determined number of coins or tokens for driving at least the movable part of the animal figure and the gating means to transport a prize containing package from the outlet of the prize containing receptacle to the inlet of the internal passage so that the prize containing package is released from the prize-containing receptacle into the passage.

The gating means can include a driven wheel attached to the movable part of the animal-like figure, the driven wheel having an opening aligned with the inlet to the passage in the movable part of the animal-like figure. The drive means can include an electric stepper motor and a drive wheel driven by the stepper, the drive wheel and the driven wheel being connected by a drive belt.

The drive means can be located beneath the prize-containing package receptacle and the prize-containing package receptacle can have a bottom comprising a number of surfaces coverging towards the outlet. The bottom surfaces of the receptacle can converge towards a substantially circular flat surface that defines an outlet. The outlet has an obstruction substantially in the shape of a pie-shaped segment preventing passage of a prize-containing package from the prize-containing package receptacle to the opening in the driven wheel until the machine is activated by insertion of a coin or token.

The actuating means can include means to operate the drive means so that the movable part of the animal-like figure moves backwards and forwards after a predetermined period of time has elapsed from the last insertion of coins or tokens into the actuating means.

The dispensing machine can include audio generating means capable of operation on insertion of coins or tokens into the actuating means, or by operation of the control means.

Preferably the outlet of the passage in the movable part of the animal-like figure is aligned with an open ended bucket so that the prize containing packages fall through the bucket into the prize receiving receptacle.

The movable part of the animal-like figure can be the head of an animal-like figure.

Preferably the animal-like figure can represent an elephant, in which the case the passage comprises the trunk of the elephant. Preferably the prize containing packages are spherical as are the non-prize containing packages.

Figure 2:
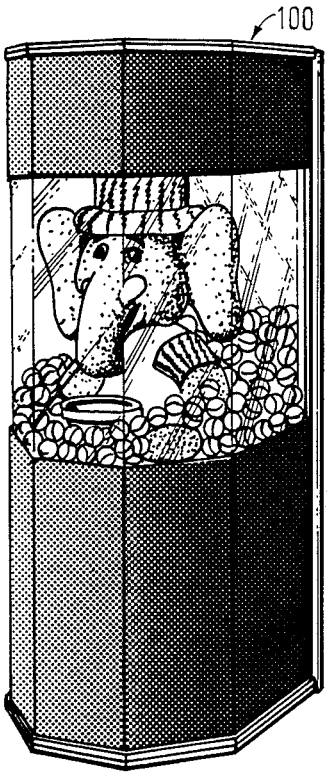
Figure 3:
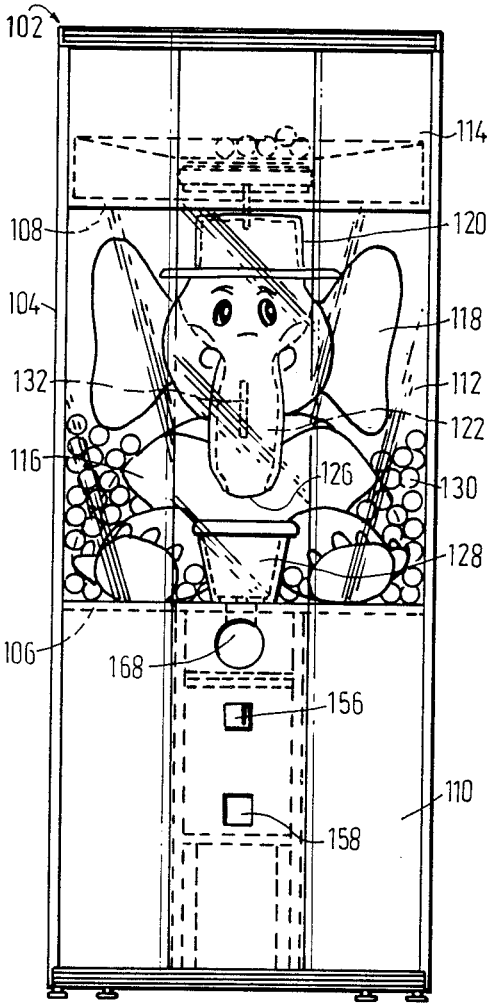
Figure 4:
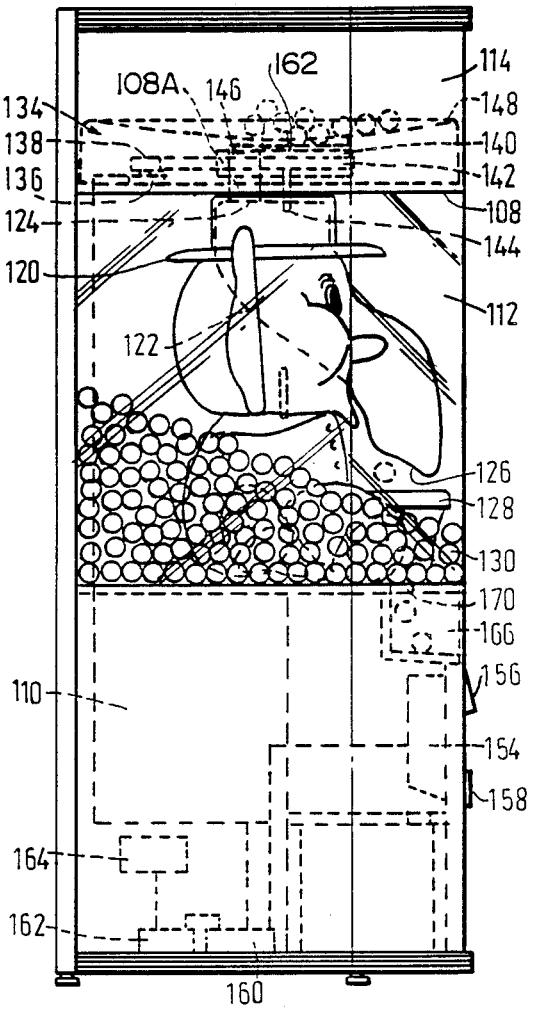

The present invention will now be more particularly described with reference to the accompanying drawings in which, FIG. 1 shows a diagrammatic representation of one form of dispensing machine according to the present invention, FIG. 2 shows a perspective view of a further form of dispensing machine according to the present invention, FIG. 3 is front elevation of the dispensing machine shown in FIG. 2, FIG. 4 is a side elevation of the dispensing machine shown in FIGS. 2 and 3, and FIGS. 5A and 5B are plan views, before and shortly after activation respectively, of the dispensing machine shown in FIGS. 2–4.

A vending or gaming machine 10 includes a casing 12 in which is located an animal-like figure, in this case an elephant, of which the head 14 is rotatable about a vertical axis as indicated by the arrow A.

The head includes a passage 16 which is simulated at least in part by the trunk of the elephant, the passage 16 having an inlet 18 and an outlet 20.

A receptacle 22 is located above the elephant head 14 and contains prizes enclosed in balls 24. The receptacle 22 has an outlet 26 with which the inlet 18 of the passage 16 can be in register.

An open ended bucket 28 is positioned underneath the outlet 20 of the passage 16, and an outlet receptacle 30 is positioned beneath the bottom of the bucket 28.

The housing 12 also contains further balls 32 located behind a transparent screen (not shown) which do not contain prizes, and can be held in suspension as illustrated by a flow of air generated by air blowers 34. The transparent screen divides off the elephant head 14 from the balls 32 so that none of the balls 32 can enter the passage 16. The elephant head 14 has means (not shown) to rotate the head about a vertical axis, for example in the direction of arrow 'A', and the outlet 26 has gating means (not shown) which are operable to release one prize at a time from the receptacle 22, the gating means providing selective communication between the outlet 26 and inlet 18. One type of suitable gating means is described with reference to the second embodiment of FIGS. 2–5.

The machine has a coin or token inlet 36 for coins or tokens.

In operation, when the correct number of coins or tokens are inserted through the slot 36, the elephant head will rotate and the air blowers 34, which can be operated continuously, generate an upwards air flow causing the balls 32 to be suspended in the air stream. It will appear that the elephant head rotates through the flow of balls 32 and picks up one of these balls at random.

In fact, when the inlet 18 of the passage 16 is in register with the outlet 26, the gating means will operate to release one of the prize containing balls 24, and this ball will then pass through the passage 16 and the prize containing ball will fall from the elephants trunk through the bucket 28 into the outlet receptacle 30.

Therefore, whilst the machine has the appearance of a machine which dispenses prizes as a matter of chance, since it is not apparent that the ball which is discharged from the passage 16 is not one of the balls 32, in fact upon insertion of the correct coins or tokens, a prize will be dispensed on every occasion.

As has been mentioned, the flow of balls 32, that is in the non-prize containing balls, can be sustained continuously. Also the whole of the body of the animal-like figure can be made rotatable rather than just the head. Also figures other than elephants or animals can be used as the medium for guiding the prizes to the outlet receptacle.

Referring to FIGS. 2, 3, 4, 5A and 5B a dispensing machine 100 comprises a cabinet 102, comprising an outer casing 104, divided by partitions 106 and 108 into three compartments 110, 112 and 114.

In the middle compartment 112 there is located an animal-like figure, in this case a part torso 116 and head 118 of an elephant. A hat 120 is provided for the head and the head has an internal passage 122 provided with an inlet 124 in the top of the hat and an outlet 126 at the end of the trunk on the head.

An open bottomed bucket 128 is secured to the partition 106 and the compartment 112 is partially filled with non-prize containing packages 130.

The head 118 is mounted for rotation upon a spindle 132 which is secured to the part torso 116 and the head 118 is rotated relative to the part torso 116 by drive means 134 located in the upper compartment 114. The drive means comprises a stepper motor 136, and a drive wheel 138 driven by the stepper motor.

A driven wheel 140 is connected to the head 118 by a shaft 144, which is secured to the hat 120. The driven wheel 140 is connected to the drive wheel 138 by a drive belt 142. The driven wheel 140 has an opening 146 which is aligned with the inlet 124 in the hat 120. The opening 146 and inlet 124 rotate together in alignment. However, since the partition 108 separates the opening 146 from the inlet 124, a stationary partition opening 108A is provided in the partition 108 to permit communication between the opening 146 and the inlet 124 upon their alignment with the partition opening 108A.

A prize-containing package receptacle tray 148 is also located in the upper compartment 114 and rests on the partition 108. The tray 148 is a hollow moulding and the drive means 134 is located under the tray. The space between the bottom of the tray 148 and the top of the partition 108 is sufficient to accomodate the driven wheel 140 and a prize containing package within the opening 146. Further, the opening 146 in the driven wheel 140 is sized (FIG. 5) to receive a single prize containing package.

The bottom of the tray 148 is formed of a number of converging surfaces A, B, C, D, E, F (FIG. 5A) which converge towards substantially circular outlet 152. Upper surface 150 of driven wheel 140 provides a flat surface or floor for outlet 152 of tray 148. Extending from tray 148 segment A is a substantially pie-shaped extension 151 that covers opening 146 in driven wheel 140 preventing prize containing packages from exiting upper compartment 114 when the machine is in the position shown in FIG. 4. Partition opening 108A lies below extension 151 thereby being offset from outlet 152. When the opening 146 in the driven wheel 140 and the inlet 124 to the passage 122 in the head 118 are aligned with the partition opening 108A, the outlet 152 is blocked by the top surface 150 of the wheel 140.

The tray 148 contains a number of prize-containing packages and the whole of the upper compartment 114 can be filled with prize-containing packages if required.

The lower compartment contains actuating means comprising a mechanism 154 having an opening 156 for the insertion of coins or tokens. Any rejected coins or tokens can be retrived from an outlet 158.

The coin mechanism 154 is connected to a control apparatus 160 which in turn is connected the stepper motor 136 and also to an audio generator 162, having a loud speaker 164.

The prize receiving receptacle 166 is also provided in the compartment 110, and has an opening 168 so that the prize-containing packages can be retrieved. An opening 170 is provided in the partition 106 enabling the prize-containing packages to fall through the bottom of the bucket 128 into the receptacle 166.

Figure 5A:
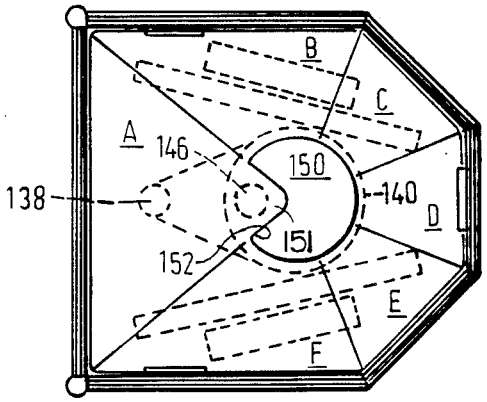
Figure 5B:
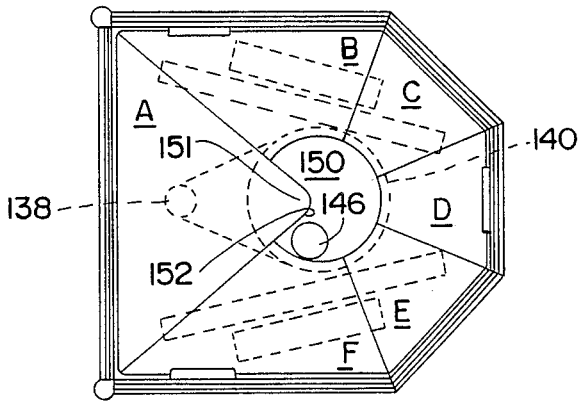

At the start of the operating cycle with the head shown in the FIG. 4 position, the opening 146 in the driven wheel 140, the passage 108A in the partition 108 and the inlet 124 to the passage in the head 118 are all aligned with one another. The solid portion of top surface 150 of the driven wheel 140 blocks the outlet 152 of the tray 148. Thus, the prize-containing packages rest on the upper surface of the wheel 140. Rotation of the wheel 140 as illustrated in FIG. 5B (which also rotates the head 118, inlet 124 and passage 122), brings the opening 146 in the driven wheel 140 under a lead portion of the outlet 152 in the tray 148 so that a prize-containing package drops into the opening 146 (which is sized to receive one prize-containing package). Even though the opening 146 and inlet 124 rotate together in alignment, the prize-containing package does not drop into the inlet 124 because of the partition 108 separating the opening 146 from the inlet 124. Thus, the prize-containing package rests on the partition 108 since rotation of the wheel 140 moved the opening 146 and inlet 124 out of alignment with the partition opening 108A. The prize-containing package is transported in the wheel opening 146 along the partition 108 between the tray 148 and partition 108 until the wheel 146 reaches its starting position whereupon the opening 146 and inlet 124 are aligned with the partition opening 108A, so that the prize-containing package drops through the partition opening 108A and into the inlet 124 of the passage 122. In upper compartment 114, additional prize-containing packages remain in the outlet 152, but their passage is blocked by the upper surface of the driven wheel 140 until the next cycle of operation in which one of the prize-containing packages in the outlet 152 will be picked up by the opening 146 in the driven wheel. Thus, the combination of opening 146 in driven wheel 140 and the offset relationship of outlet 152 and partition opening 108A provide a movable trap chamber.

In operation, coins or tokens to the required amount are inserted in the mechanism 154 through the opening 156, and once the correct number of coins or tokens have been inserted, the control apparatus 160 switches on the stepper motor 136 and also the audio generator 162. The audio generator can for example comprise a tape recorder having an endless tape. The stepper motor 136 through the drive and driven wheels 138 and 140, rotates the head 118 through one complete revolution of 360° and the head will move through the pile of non-prize containing packages 130 located in the central compartment 112. At the end of the cycle the opening 146 in the driven wheel 140 has picked up one prize-containing package from the outlet 152 in the receptacle tray 148, and transported it to the partition opening 108A, so that one prize-containing package will pass from the tray through the opening 146 and into the inlet 124 of the passage 122. The prize-containing package will roll down the passage and out of the outlet 126 at the end of the trunk on the head 118. The prize-containing package will then pass through the open bottom bucket 128 and into the prize receiving receptacle 166. The prize-containing package can then be retrieved through the opening 168. To the user of the dispensing machine it will appear that one of the non-prize containing packages 130, has been retrived by the trunk and discharged from the trunk, though the user is not aware that the packages 130 do not contain prizes and is not aware of the source of the prize containing packages.

The non-prize containing packages 130 can be maintained in motion by a stream of air generated by any appropriate draft inducing device such as a fan (not shown).

It will be appreciated that the prize-containing packages in the upper compartment 114 are normally prevented from being discharged by the driven wheel 140 until the opening 146 in the driven wheel is rotated beneath; the outlet 152 in the bottom of the tray 148. Thus, the partition opening 108A in the partition 108 cooperates with the opening 146 in the driven wheel 140, the inlet 124 of the passage 122, and the outlet 152 in the tray 148 to function as a gating mechanism for dispensing one-prize containing package per cycle.

The control means 160 can be associated with a timer T and programmed to operate the drive means 134 after a predetermined period of time has elapsed, since a coin or token was last inserted into the mechanism 154. For example, the drive means can be actuated to move the head 118 backward and forwards and also to play a whole or part of a tune contained in the audio generator 162. This sequence can be repeated any number of times. It can also be arranged after the elapse of a further predetermined period of time, that the drive means can be actuated by the control apparatus 160 so that the head completes nearly a whole turn and a complete tune is played by the audio generator 162.

I claim:

1. A dispensing machine comprising: a first receptacle having an outlet for a plurality of prize-containing packages; a second receptacle having an animal-like figure at least a part of which is movable relative to the first prize-containing receptacle; a partition separating the first receptacle from the second receptacle, and including a partition opening offset from the outlet of the first receptacle; said movable part of the animal-like figure in the second receptacle having an internal passage with an inlet capable of being in register with the partition opening in the partition, and an outlet arranged to discharge prizes to a third prize receiving receptacle; and gating means disposed between the first and second receptacles for transporting a prize-containing package from the outlet of the first receptacle to the partition opening for entry into the inlet of the internal passage in the second receptacle; the machine further comprising a plurality of non-prize containing packages in the second receptacle through which the movable part of the animal-like figure is movable, actuating means comprising a mechanism arranged to receive coins or tokens, and drive means actuated by the actuating means upon receipt of a predetermined number of coins or tokens for driving at least the movable part of the animal-like figure and the gating means to receive a prize-containing package from the outlet of the first receptacle and transport the prize-containing package from the outlet of the first receptacle to the partition opening for entry into the inlet of the internal passage in the second receptacle so that the prize-containing package is released from the prize-containing receptacle into the passage.

2. A dispensing machine as claimed in claim 1 wherein the gating means includes a driven wheel attached to the movable part of the animal-like figure and rotating therewith, the driven wheel having an opening aligned with the inlet to the passage in the movable part of the animal-like figure, the opening in the driven wheel receiving the prize-containing package from the outlet of the first receptacle for transport to the partition opening.

3. A dispensing machine as claimed in claim 2, which the drive means comprises a electric stepper motor, a drive wheel driven by the stepper motor and a drive belt positioned on the drive and driven wheels.

4. A dispensing machine as claimed in claim 1 wherein the drive means are located beneath the first prize-containing package receptacle, the first receptacle having bottom surfaces converging towards the outlet.

5. A dispensing machine as claimed in claim 4, wherein the bottom surfaces of the receptacle converge towards a generally circular shaped outlet and having an extension of one of the bottom surfaces extending into said outlet to create a segmental shaped outlet.

6. A dispensing machine as claimed in claim 1 wherein the actuating means include control means with a timer for actuating the drive means to move the movable part of the animal-like figure backwards and forwards after a predetermined period of time has elapsed from the last insertion of coins or tokens into the actuating means.

7. A dispensing machine as claimed in claim 6 including audio generating means capable of operation upon insertion of coins or tokens into the actuating means, or by operation of the control means.

8. A dispensing machine as claimed in claim 1 wherein the movable part of an animal-like figure is the head of the animal-like figure.

9. A dispensing machine as claimed in claim 8, wherein the animal-like figure is an elephant and the passage is provided internally of the head including the trunk.

10. A dispensing machine as claimed in claim 1 further comprising draft inducing means in the second receptacle capable of maintaining the non-prize containing packages in motion.

* * * * *